United States Patent [19]

Von Holdt

[11] Patent Number: 4,706,838

[45] Date of Patent: Nov. 17, 1987

[54] MOLDED PULL FITTING

[76] Inventor: John W. Von Holdt, 6864 Lexington La., Niles, Ill. 60648

[21] Appl. No.: 904,619

[22] Filed: Sep. 8, 1986

[51] Int. Cl.[4] ..... B65D 17/34

[52] U.S. Cl. ..... 220/270; 220/307; 220/254

[58] Field of Search ..... 220/270, 254, 306, 307; 222/541

[56] References Cited

U.S. PATENT DOCUMENTS 4,442,949 4/1984 Dwinell et al. ..... 220/270

FOREIGN PATENT DOCUMENTS 1562177 2/1968 France ..... 222/541

*Primary Examiner*—George T. Hall

*Attorney, Agent, or Firm*—Charles F. Pigott, Jr.

[57] ABSTRACT

A molded wall carries a pull fitting which may be improved by this invention as follows: the pull fitting defines a tubular wall having an axis transverse to the molded wall, with the tubular wall being connected to the molded wall outside of the tubular wall by an annular, thin film of wall material integrally connected to both the tubular wall and the outside molded wall. The tubular wall also defines, on its outer surface, an annular groove proportioned in size and shape to receive in snap-fit relation an annular edge of the outside, molded wall which is exposed upon severing of the annular, thin film and removing the fitting. Thus, the fitting may be reattached to the molded wall.

7 Claims, 7 Drawing Figures

FIG. 1
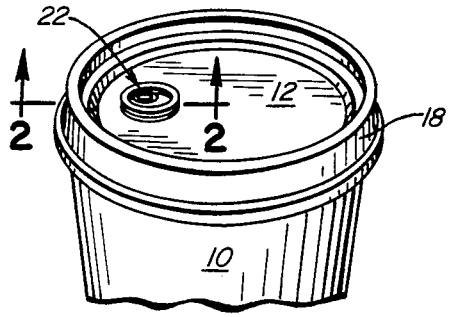
FIG. 2
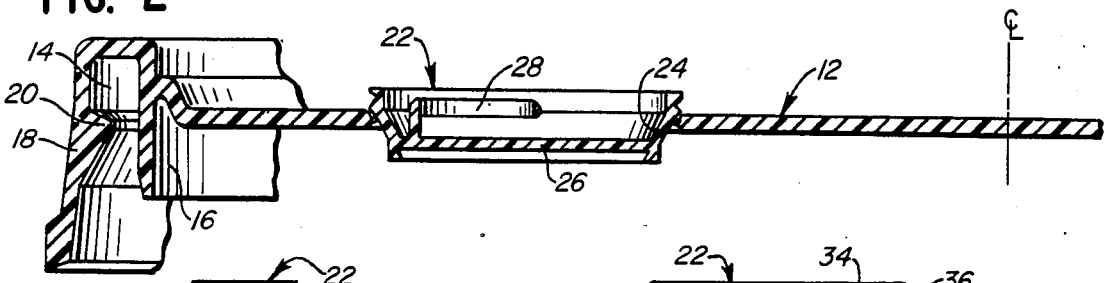
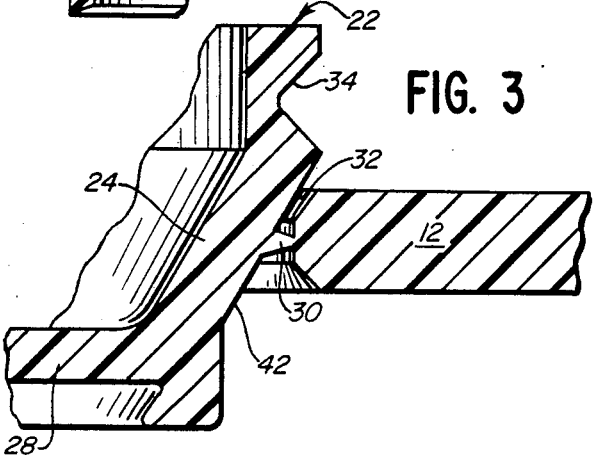
FIG. 3
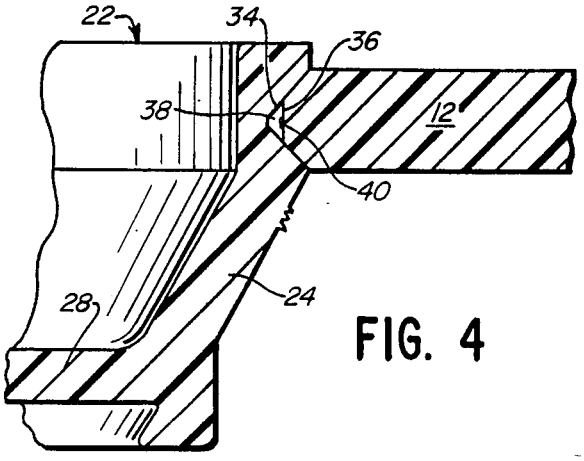
FIG. 4
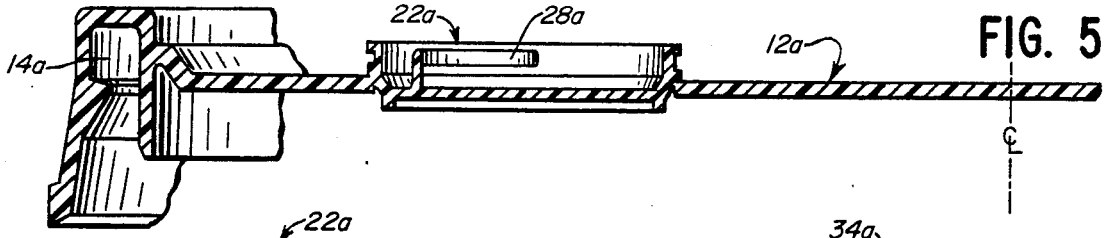
FIG. 5
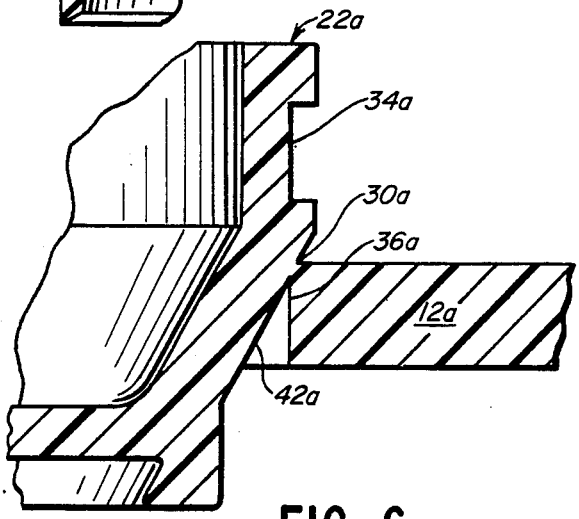
FIG. 6
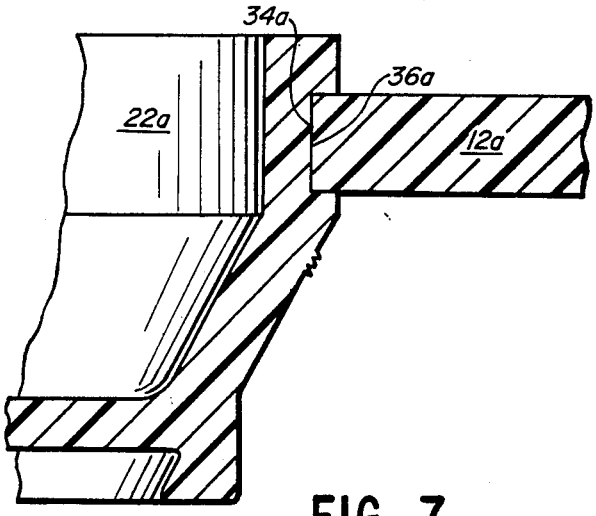
FIG. 7

MOLDED PULL FITTING

BACKGROUND OF THE INVENTION

This application relates to an improvement in pull fittings which may be found in molded walls for container lids and the like.

There are a multitude of assorted fittings which permit access into a container. Beginning with the cork in the bottle, the object has been to provide sealing of the container with its original contents, followed by easy opening, and, preferably, a capability of resealing the container after initial use.

In the packaging area there is always a significant need for providing a sealed opening system, preferably having a resealing capability, at the minimum possible cost, since price pressures are particularly significant in the packaging field. By this invention, a resealable pull fitting is provided which may be integrally molded into a molded wall, for example a snap-on lid for a molded container such as a bucket or the like. Accordingly, a pull fitting is provided which can be manufactured with essentially no greater cost or consumption of time than is required to mold the wall in which the pull fitting resides.

Initially, the system of this invention provides complete sealing, substantially as if only the molded wall were there without the pull fitting. Nevertheless, the fitting may be removed. The contents from the container may be extracted or inserted, and the pull fitting may then be replaced in a snap-fitting, sealed relationship, all at a vanishingly small manufacturing cost increment over the manufacturing cost of the molded wall itself, because the pull fitting is integrally molded with the molded wall in a single, easy molding step.

DESCRIPTION OF THE INVENTION

In this invention, a molded wall carries a pull fitting, which pull fitting defines a tubular wall having an axis transverse to the molded wall. The tubular wall is integrally connected to the molded wall outside of the tubular wall by an annular, thin film of wall material integrally connected to both said tubular wall and outside molded wall. The tubular wall also defines, on its outer surface, an annular groove proportioned in size and shape to receive in snap-fit relation an annular edge of the outside, molded wall which is exposed upon severing of said annular, thin film and removing of said fitting. Thus, the fitting can be reattached to the molded wall once again after removal.

Typically, the fitting carries a transverse wall closing off its tubular bore. Likewise, a pull tab may be provided to facilitate removal of the fitting by tearing of the annular, thin film.

Preferably, the portion of the tubular wall which defines the annular groove may be of generally larger transverse dimension than the portion of the annular, thin film. By this expedient, upon reapplication of the pull fitting for reclosing, the snap-fit relation between the annular groove and the annular edge of the outside, molded wall may be facilitated, since the larger diameter or other transverse dimension of the annular groove causes it to be able to press outwardly against the annular edge of the outside, molded wall. Generally, the innermost portion of the annular groove has a diameter or other transverse dimension which is substantially equivalent to the transverse dimension of the annular, thin film of wall material which is ruptured by removal of the pull fitting.

While the pull fitting is disclosed as defining a tubular wall of generally circular cross-section, but varying in diameter along its length, it is contemplated that the tubular wall might be of square cross-section, oval cross-section, or other shapes as may be desired.

DESCRIPTION OF THE DRAWINGS

Referring to the drawings,

FIG. 1 is a partial prespective view of a bucket carrying a snap-on lid which includes the pull fitting of this invention;

FIG. 2 is a sectional view taken along line 2—2 of FIG. 1;

FIG. 3 is a highly magnified, sectional view in accordance with FIG. 2 of a portion of the pull fitting in its original, as-molded configuration;

FIG. 4 is a sectional view similar to FIG. 3 showing the pull fitting in its reattached position, after removal for obtaining access to the container contents;

FIG. 5 is a sectional view similar to FIG. 2 but showing a different embodiment of the pull fitting of this invention;

FIG. 6 is a highly magnified, fragmentary sectional view of a portion of the pull fitting of FIG. 5 in its original, as-molded configuration; and FIG. 7 is a sectional view similar to FIG. 6 showing the position of the pull fitting after it has been removed and reattached.

DESCRIPTION OF SPECIFIC EMBODIMENTS

Referring to FIGS. 1 through 4, a molded plastic bucket 10 for paint and the like carries a snap-on lid 12 of generally known design, except for the modifications described herein. Lid 12 defines a peripherally positioned, annular recess 14 positioned between inner and outer annular walls 16, 18, to receive inner and outer annular walls 16, 18 to receive the lip of bucket 10 in retained, sealing relation. The shape of the bucket lip may be substantially similar to the shape of recess 14 to provide interlocking relation with inwardly projecting ring 20 of lip 14.

In accordance with this invention, pull fitting 22 is provided, being an integrally molded part of lid 14. It can be seen that the particular shape of pull fitting 22 does not require an extraordinarily complex mold modification in order to cause it to be formed along with each molded bucket lid 12. Furthermore, there is little if any significant increase in molding time required by the presence of pull fitting 22, so that the manufacturing efficiency of a molding operation of bucket lid 12 is substantially the same as the manufacturing efficiency of a bucket lid similar to lid 12 but without pull fitting 22.

Pull fitting 22 includes a tubular wall 24, the bore of which is closed off adjacent the inner end by transverse wall 26. Mounted on transverse wall 26 is a pull tab 28 which may be in the form of a pull ring as shown, or, if desired, a pull strip having transversely positioned ribs to increase manual grippability, or any other desired design, such as a pull tab for pliers.

As shown particularly in FIG. 3, tubular wall 24 of pull fitting 22, and the molded wall 12 outside of tubular wall 24, are integrally connected and sealed by an annular, thin film portion 30 of molded wall 12. Thus, a hermetic seal is initially provided between pull fitting 22 and the rest of molded wall 12.

Nevertheless, when it is desired to gain access to the contents of container 10, one may grasp pull tab 28 and manually remove pull fitting 22 from its position, since annular, thin film 30 may be ruptured by such action. Thereafter, when one wishes to reclose the container, one can force pull fitting 22 back into the aperture 32 to enter into the configuration of FIG. 4. Annular groove 34 enters into snap-fit relation with annular edge 36 of the molded wall 12 positioned outside of pull fitting 22. Preferably, annular groove 34 may be of triangular cross-section as shown, while edge 36 is generally blunt, to provide an annular space 38. Space 38 provides room for the annular fragment 40 of annular, thin film 30 which remains with wall 12 as pull fitting 22 is removed. Thus, a good seal can be achieved between annular groove 34 and annular edge 36 without interference from fragment 40.

Whenever desired, pull fitting 22 may be once again removed by manually gripping pull tab 28 and removing.

It should also be noted that at least the outer portions of annular groove 34 are positioned outwardly from the initial position of annular, thin film 30, for the purpose of facilitating the snap-fit relation between annular groove 34 and annular edge 36. This snap-fit relation is provided by the natural, springing resilience of pull fitting 22 and the rest of wall 12.

Turning now to FIGS. 5 through 7, molded wall **12*a* may be of essentially similar design to molded wall 12, except for a design modification of pull fitting 22*a*, the details of which are shown in FIGS. 6 and 7**.

Molded wall **12*a* may define retaining slot 14*a*, of similar design to slot 14, for retaining the lip of a bucket. Pull fitting 22*a* may define annular groove 34*a*, which in this instance may be of square cross-section. Thin film 30*a* may be defined between an inner corner of the outer portion of wall 12*a* and a conical section surface 42*a* of pull fitting 22*a*, similar to conical section surface 42** of the previous embodiment.

Accordingly, the pull tab **28*a* may be used to rupture annular, thin film 30*a* and remove pull fitting 22*a*** in a manner similar to the previous embodiment.

When it is desired to replace pull fitting **22*a* into reclosing position, one forces fitting 22*a* into its position as shown in FIG. 7, where end 36*a* of the outer portion of wall 12*a* enters into snap-fit relation with annular groove 34*a***, for resealing of the container.

The above has been offered for illustrative purposes only, and is not intended to limit the scope of the invention of this application, which is as defined in the claims below.

That which is claimed:

1. In a molded wall which carries a pull fitting, the improvement comprising, in combination:

said pull fitting defining a tubular wall having an axis transverse to said molded wall, said tubular wall being integrally connected to said molded wall outside of said tubular wall by an annular, thin film of wall material integrally connected to both said tubular wall and outside molded wall; said tubular wall also defining, on its outer surface, an annular groove proportioned in size and shape to receive in snap-fit relation an annular edge of said outside, molded wall which is exposed upon severing of said annular, thin film, and removing of said fitting, to permit reattachment of said fitting to the molded wall, the annular groove and annular edge of the outside, molded wall being proportioned to provide an annular, enclosed space therebetween when connected together, whereby remains of said annular, thin film may reside therein without interfering with the seal between said annular groove and annular edge.

2. The molded wall of claim 1 in which the portion of said tubular wall which defines said annular groove is of generally larger transverse dimension than the portion of said tubular wall which defines the connection with said annular, thin film, to facilitate said snap-fit relation.

3. The molded wall of claim 1 in which said fitting defines a tubular bore, and a transverse wall closing off said bore.

4. The molded wall of claim 1 in which said fitting defines a pull tab to facilitate removal thereof.

5. In a molded wall which carries a pull fitting, the improvement comprising, in combination:

said pull fitting defining a tubular wall having an axis transverse to the wall, said tubular wall being integrally connected to said molded wall outside of said tubular wall by an annular, thin film of wall material integrally connected to both said tubular wall and outside molded wall; said tubular wall also defining, on its outer surface, an annular groove proportioned in size and shape to receive in snap-fit relation an annular edge of said outside, molded wall which is exposed upon severing of said annular thin film, and removing of said fitting, to permit reattachment of said fitting to the molded wall, said fitting also defining a tubular bore, and a transverse wall closing off said bore; a portion of said tubular wall which defines said annular groove being of generally larger transverse dimension than the portion of said tubular wall which defines the connection with said annular, thin film, to facilitate said snap-fit relation, said annular groove being proportioned in size and shape to form an annular seal with said annular edge received in snap-fit relation, said annular groove and annular edge defining betweem them, when connected together, an annular enclosed space whereby remains of said annular, thin film may reside therein without interfering with the seal between said annular groove and annular edge.

6. The molded wall of claim 5 in which said fitting defines a pull tab to facilitate removal thereof.

7. The molded wall of claim 6 which constitutes part of a lid for a container.

* * * * *